US005928843A

United States Patent [19]

Van de Wynckel

[11] Patent Number: 5,928,843

[45] Date of Patent: Jul. 27, 1999

[54] METHOD FOR PROCESSING EXPOSED SILVER-BASED PHOTOGRAPHIC MATERIAL

[75] Inventor: Werner Van de Wynckel, Mortsel, Belgium

[73] Assignee: Agfa-Gevaerf, Mortsel, Belgium

[21] Appl. No.: 09/054,803

[22] Filed: Apr. 3, 1998

[30] Foreign Application Priority Data

Apr. 15, 1997 [EP] European Pat. Off. ..... 97201117

[51] Int. Cl.[6] ..... G03C 5/395

[52] U.S. Cl. ..... 430/398; 430/400

[58] Field of Search ..... 430/398, 400

[56] References Cited

U.S. PATENT DOCUMENTS

| | | | |
|---|---|---|---|
| 4,139,431 | 2/1979 | Scheidegger et al. | 430/398 |
| 4,314,753 | 2/1982 | Kaufmann | 354/321 |
| 4,486,082 | 12/1984 | Wagner et al. | 354/6 |
| 5,180,648 | 1/1993 | Nakamura | 430/400 |
| 5,427,877 | 6/1995 | Green et al. | 430/398 |
| 5,480,769 | 1/1996 | Ueffinger et al. | 430/398 |

FOREIGN PATENT DOCUMENTS 4127454 of 0000 Germany .

OTHER PUBLICATIONS

Questel Plus—Epoque 8912 8912; Sep. 24, 1997; p. 1; XP002041704. JP 3053245 Mar. 1991 Abstract.

*Primary Examiner*—Hoa Van Le
*Attorney, Agent, or Firm*—Baker & Botts, L.L.P.

[57] ABSTRACT

A method for processing exposed silver-based photographic material comprises passing the exposed material through a bath of developer liquid and subsequently through a bath of fixer liquid. Silver from used fixer liquid is recovered by electrolysis. The fractional image exposure of exposed material to be processed in a coming period and the amount-of silver recovered by electrolysis in a preceding period are measured. The used fixer liquid is periodically regenerated by the addition of fresh fixer thereto. The quantity of fresh fixer to be added is calculated as a function of the measured fractional image exposure and as a function of the measured amount of recovered silver. The quality of the fixer is thereby maintained at an optimum level while keeping the quantity of fresh fixer which is used to a minimum.

3 Claims, 3 Drawing Sheets

METHOD FOR PROCESSING EXPOSED SILVER-BASED PHOTOGRAPHIC MATERIAL

FIELD OF THE INVENTION

The present invention relates to a method for processing exposed silver-based photographic material, in particular sheet material such as X-ray film, pre-sensitised plates, graphic art film and paper, and offset plates.

BACKGROUND OF INVENTION

A typical method for processing exposed silver-based photographic material comprises passing the exposed material through a bath of developer liquid and subsequently through a bath of fixer liquid. The fixer usually contains thiosulphate, which removes silver from unexposed parts of the photographic material. Because of the consumption of thiosulphate, it is necessary to periodically regenerate used fixer liquid by the addition of fresh fixer thereto if consistent fixing results are to be achieved. It is desirable that the quality of the treatment liquid in the fixing bath remains at an optimum level during processing, even when the processing apparatus is being used erratically. In other words it is desirable to calculate a desired fixer replenishment rate.

It has been proposed, for example in Japanese patent application JN03053245 (Fuji Shashin Film), to calculate the quantity of fresh fixer which needs to be added on the basis of the nature of the images carried on the photographic material which are to be fixed during the coming period, in particular upon the image density. Information on the image density may be obtained from the imaging apparatus which produces the exposed photographic material, especially where this is a laser exposure device.

However, this method of calculating replenishment rates is not wholly satisfactory. The actual depletion of active components in the fixer during fixing of the photographic material may not correspond exactly to that predicted from the image data. This may occur, for example, where the photographic material is not completely developed, leaving greater amounts of silver halide in emulsion than might have been predicted, and therefore consuming higher than predicted amounts of active components in the fixer. Even if these differences are small, over time their effect may be cumulative, resulting in significant under- or over-replenishment. Over time, the concentration of active components in the fixer may change as a result of oxidation and evaporation, and these changes tend to occur even at times when the fixer is not being used. There is therefore a risk that insufficient fresh fixer is added to maintain the activity of the fixer at an optimum level.

Furthermore, the problem of optimising fixer regeneration is complicated by the carry-over of developer into the fixing bath, which may deactivate some components of the fixer. Depending upon the design of the processing apparatus, particularly the squeegee rollers used therein, the amount of this carry-over may depend upon the shape and quantity of photographic material processed, independent of the image density thereon. The error in calculated replenishment rates will be particularly significant when replenishment rates are low, for example when average image density is high.

Some processing methods use an electrolytic technique to remove the silver which builds up in the fixer as it is used, for example by continuously circulating the fixer through an electrolytic silver recovery cell. In the silver recovery cell, not only is silver extracted at the cathode and thiosulphate is regenerated, but some sulphite is destroyed at the anode. The amount of silver extracted during a given period, which can be calculated from the electrical energy input into the cell, is related to the image density of the photographic material which has been processed during that period. It might be supposed therefore, that the calculation of the fixer replenishment rate can be based upon the quantity of silver extracted by this electrolytic technique.

However, electrolysis results are generated rather slowly, compared with the rate at which the silver is extracted from the photographic material. If a peak in processing throughput should occur, the electrolysis may fall behind, resulting in an inadequate level of replenishment being calculated and therefore starvation of the fixer may occur. Furthermore, should the activity of the fixer fall below optimum, this results in poorer fixing and consequently a lower level of silver being brought into solution to be extracted by electrolysis. The consequential fall-off in silver extraction is not immediately an indication of poor fixer activity.

OBJECTS OF INVENTION

The present invention seeks to provide a process whereby the quality of the fixer remains at an optimum level while reducing the quantity of fresh fixer which is used, without the aforesaid disadvantages.

SUMMARY OF THE INVENTION

We have discovered that this and other useful objectives can be achieved by calculating the quantity of fresh fixer to be added as a function of the fractional image exposure of the exposed material to be processed and as a function of the amount of recovered silver.

Thus, according to the invention, there is provided a method for processing exposed silver-based photographic material comprising passing the exposed material through a bath of developer liquid and subsequently through a bath of fixer liquid, recovering silver from used fixer liquid by electrolysis and periodically regenerating the used fixer liquid by the addition of fresh fixer thereto, characterised by measuring the fractional image exposure of exposed material to be processed in a coming period, measuring the amount of silver recovered by electrolysis in a preceding period, and calculating the quantity of fresh fixer to be added as a function of the measured fractional image exposure and as a function of the measured amount of recovered silver.

Preferably, the bath of fixer liquid is present in a closed processing apparatus. By this feature, the effects of the evaporation and oxidation of the fixer over time can be substantially eliminated. The processing apparatus may have a vertical or a horizontal configuration, or a combination thereof.

The fresh fixer is preferably added periodically, the quantity of fresh fixer ($Q_n$) to be added per unit area of photographic material (typically in ml/m$^2$) being calculated according to the formula:

$$Q_n = K_1 + (1-\alpha).C_n \quad (1)$$

wherein:

$K_1$ is a first constant, specific to a given processing apparatus (typically in ml/m$^2$);

$\alpha$ is the average fractional image density, based on the total area of the photographic material to be processed in the coming period (unit-less); and $$c_n = \frac{t=n-1\int^{t=n} I dt * k_2}{t=n-1\int^{t=n}(1-\alpha)M\,dt} \quad (2)$$

where

I=the average electrolysis current during the preceding period (typically in Amperes), t=the time of the preceding period (typically in hours);

$k_2$=a second constant (typically in ml/amp-hour) which includes the product of the theoretical weight of silver extracted per amp-hour and the assumed efficiency of the process; and M=the area of exposed material processed during the coming time period (typically in $m^{2/}$/hr).

The values of $K_1$ and $K_2$ can be derived empirically. The use of this formula requires a constant measurement of the area of photographic material passing through the apparatus. This can be achieved by deriving width data from movable guides positioned to contact the edges of the photographic material, the position of these guides providing an indication of the width of the material, or from optical detection devices for determining the width of the material. Movement of material feed devices, such as rollers, can be used to determine the length of the material fed through the apparatus.

In order to avoid sudden fluctuations in the amount of fresh fixer to be added, a smoothing function can be introduced in a modification of the above formulae, such as $$c_n = a * c_{n-1} + (1-a) * \frac{t=n-1\int^{t=n} I dt * k_2}{t=n-1\int^{t=n}(1-\alpha)M\,dt} \quad (3)$$

where a is between 0 and 1, such as more than 0.5, especially from 0.85 to 0.95. It will be noted that formula (3) reduces to formula (2) when a is zero.

In order to maintain consistent developed image quality, in a preferred process according to the invention, used developer is also periodically regenerated by the addition thereto of fresh developer. The quantity of fresh developer added may be calculated as a function of the fractional image exposure of the exposed material and of the amount of recovered silver. The process described in European patent application EP-A-741322 (Eastman Kodak Company) may be used for this regeneration.

The quantity of fresh developer added may be calculated according to the formula:

$$Q_{DEV}=K_3+K_4*\alpha \quad (4)$$

wherein:

$Q_{DEV}$ is the quantity of fresh developer added per unit area of photographic material (typically in ml/$m^2$);

$K_3$ is a constant which takes account of the evaporation and oxidation of the developer over time (typically in ml/$m^2$), and in a closed apparatus tends to zero; and $K_4$ is a constant which amounts to the rate of developer depleted when the image density is 100% (typically in ml/$m^2$)

DETAILED DESCRIPTION OF THE INVENTION

A suitable apparatus for carrying out the process of the invention will be described with reference to the accompanying drawings without the intention to limit the invention thereto, and in which.

Figure 1:
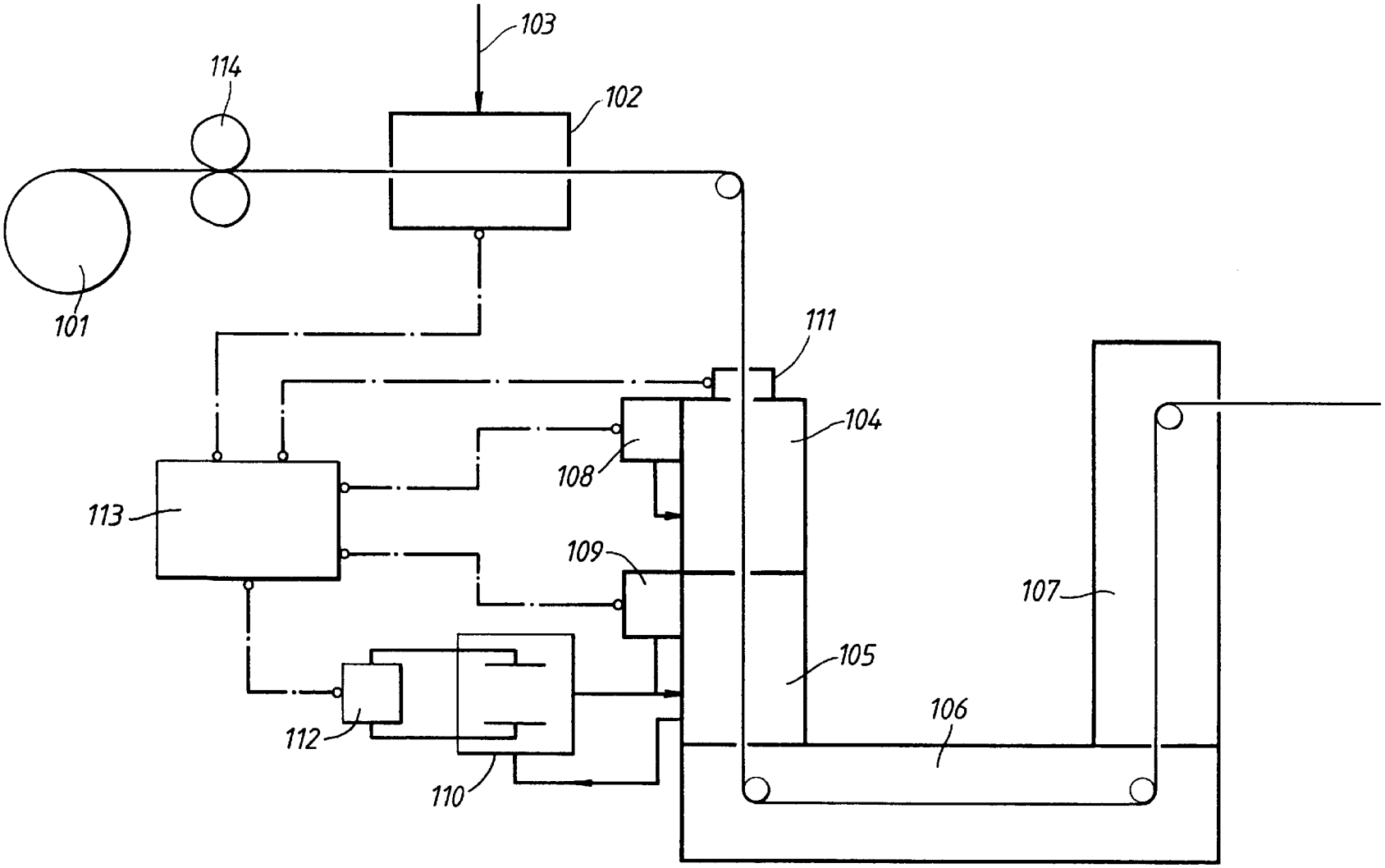
FIG. 1 shows, in schematic outline, an apparatus for carrying out the process of the present invention.

FIG. 1 shows, in a schematic manner, an apparatus including drive means 114 for feeding photographic material in the form of sheets from a supply 101 to an imaging apparatus 102. The imaging apparatus is fed with image data via a data input line 103. As well as exposing the photographic material, the imaging apparatus 102 measures the average image level. After imaging, the material passes to a processing apparatus comprising a development cell 104, a fixing cell 105, a washing cell 106 and a drying compartment 107. The developer in the development cell 104 is replenished from a fresh developer supply 108. The fixer in the fixing cell 105 is replenished from a fresh fixer supply 109. The fixer in the fixing cell 108 is circulated through a silver recovery electrolytic cell 110. A material area measuring device 111 measures the area of photographic material passing through the apparatus. Alternatively, data concerning the area of the photographic material is provided directly from the imaging apparatus 102. An electrical circuit 112 controls the application of electrical power to the electrolytic cell 110 and measures the current I fed therethrough. A control device 113, for example in the form of a microprocessor, receives data from the imaging apparatus 102, the area measuring device 111 and the electrolytic cell circuit 112 and computes therefrom the optimum regeneration rates for the developer and the fixer. The control device 113 controls the output of the fresh developer supply 108 and the fresh fixer supply 109 in accordance with this calculation.

Figure 2:
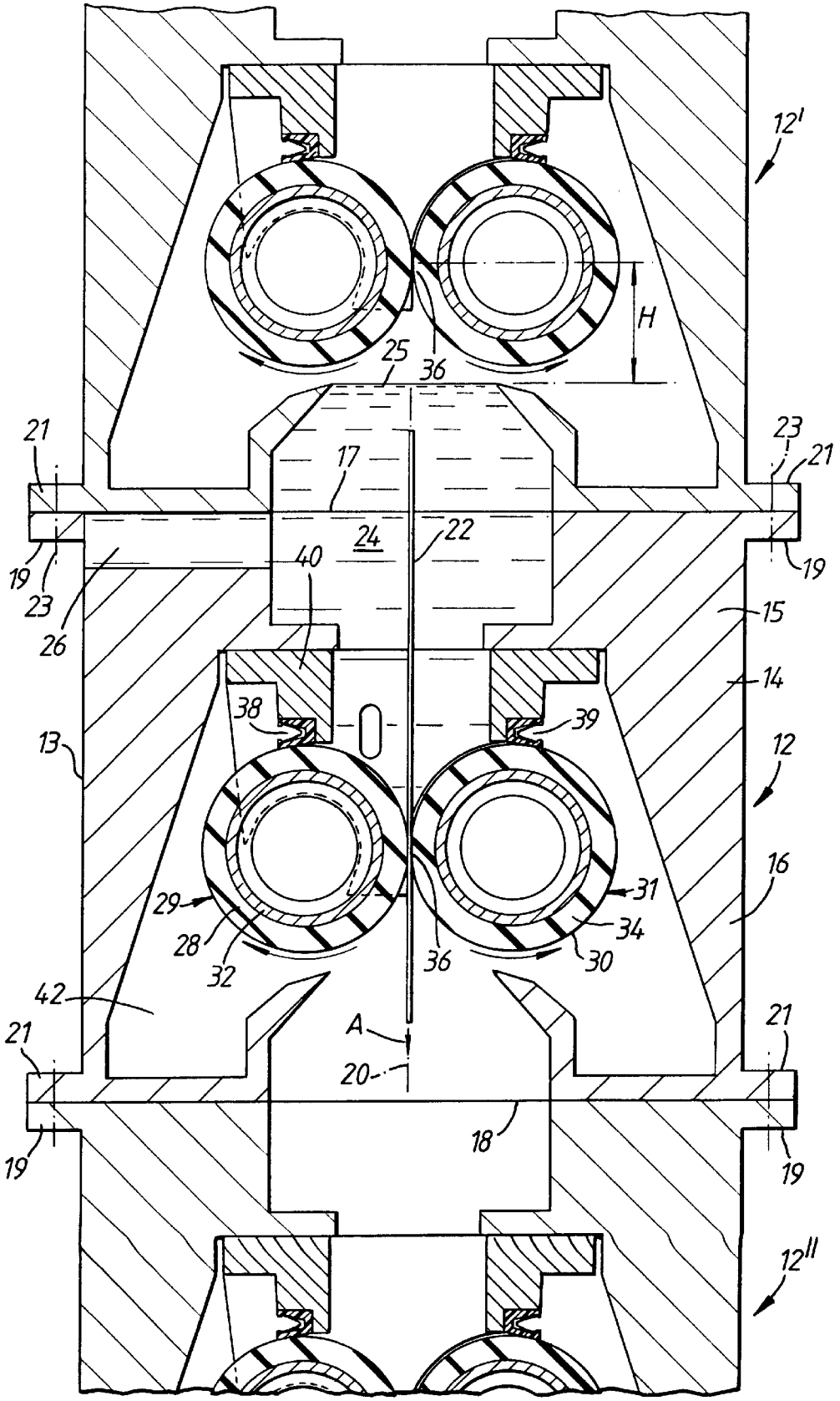
FIG. 2 is a cross-sectional view of one cell of a vertical processing apparatus for use in the process of the invention, with adjacent cells being partly shown.

The processing apparatus is shown in more detail in FIG. 2. The apparatus comprises a plurality of treatment cells 12, 12', 12" mounted one above another. These cells are arranged to provide a sequence of steps in the processing of sheet photographic material, i.e. developing, fixing, rinsing and drying. The cells may be of a modular structure as shown or may be part of an integral apparatus.

FIG. 2 shows that the cell 12 is in the form of a vessel 13 which is of generally rectangular cross-section comprising a housing defined by a housing wall 14 so shaped as to provide an upper part 15 having an upper opening 17 and a lower part 16 having a lower opening 18. The upper opening 17 constitutes a sheet material inlet and the lower opening 18 constitutes a sheet material outlet. The inlet and outlet define there-between a substantially vertical sheet material path 20 through the vessel 13, the sheet material 22 moving in a downwards direction as indicated by the arrow A. Mounted within the cell 12 are a pair of rotatable drive rollers 28, 30. The vessel 13 contains treatment liquid 24, a passage 26 through the housing wall 14 being provided as an inlet for the treatment liquid 24. The distance H between the surface 25 of the liquid 24 and the nip of the rollers of the next upper cell 12' is as low as possible.

Each roller 28, 30 is of the squeegee type comprising a stainless steel hollow core 32 carrying an elastomeric covering 34. The core 32 is in cylindrical form having constant internal and external diameters along the length thereof. The rollers 28, 30 are biased towards each other with a force sufficient to effect a liquid tight seal but without causing damage to the photographic sheet material 22 as it passes there-between. The line of contact between the roller surfaces 29 and 31 defines a nip 36. The sheet material preferably has a width which is at least 10 mm smaller than the length of the nip, so as to enable a spacing of at least 5 mm between the edges of the sheet and the adjacent limit of the nip 36, thereby to minimise leakage. The rollers 28, 30 are coupled to drive means (not shown) so as to constitute drive rollers for driving the sheet material 22 along the sheet material path 20.

Each roller 28, 30 is in sealing contact along its length, with a respective stationary sealing member 38, 39 carried on a sealing support 40, which in turn is secured to the housing wall 14 of the vessel 13, the sealing members 38, 39 serving to provide a gas- and liquid-tight seal between the rollers 28, 30 on the one hand and the housing wall 14 on the other. The treatment liquid 24 is therefore retained in the vessel 13 by the rollers 28, 30 and the sealing members 38, 39. The sealing members 38, 39 are formed of PTFE. The sealing members 38, 39 are secured to the sealing support 40 by a suitable, water- and chemical-resistant adhesive, such as a silicone adhesive. upper and lower housing wall parts 15, 16 are provided with flanges 19, 21 respectively provided with bolts indicated by broken lines 23 to enable the cell 12 to be mounted directly above or below an identical or similar other cell 12', 12", as partly indicated FIG. 2. In the illustrated embodiment, the adjacent cells 12' and 12" are non-liquid containing cells. The upper housing wall part 15 is so shaped in relation to the lower housing wall part 16 as to provide a substantially closed connection between adjacent cells. Thus, treatment liquid from vessel 13 is prevented from falling into the lower cell 12" by the rollers 28, 30 and sealing members 38, 39, while vapours from the lower cell 12" are prevented from entering the vessel 13 or escaping into the environment. This construction has the advantage that the treatment liquid in the vessel 13 is not contaminated by contents of the adjacent cells and that by virtue of the treatment liquids being in a closed system evaporation, oxidation and carbonisation thereof is significantly reduced (and any other undesirable exchange between the treatment liquid and the environment).

The lower part 16 of the housing wall 14 is so shaped as to define a leakage tray 42. Any treatment liquid which may pass through the roller nip 36, in particular as the sheet material 22 passes therethrough, drips from the rollers and falls into the leakage tray 42 from where it may be recovered and recirculated as desired.

EXAMPLES

Using an apparatus similar to that described above, a regeneration regime was adopted based on the following formulae:

$$Q_n = 20 + (1-\alpha)c_n; \tag{5}$$

$$c_n = 0.9 * c_{n-1} + 0.1 * \frac{t = n-1 \int^{t=n} I\,dt * 200}{t = n-1 \int^{t=n} (1-\alpha) M\,dt}; \text{ and} \tag{6}$$

the time interval between each addition of fresh fixer, i.e. $t_n - t_{n-1}$, is the time taken for a given area of photographic material to pass through the processor, in this example 16 $m^2$. In the Example, the photographic sheet material was S712P (ex AGFA-GEVAERT NV), the fixer was G333b (ex AGFA-GEVAERT NV), and image densities of 15% and 50% were used.

Figure 3:
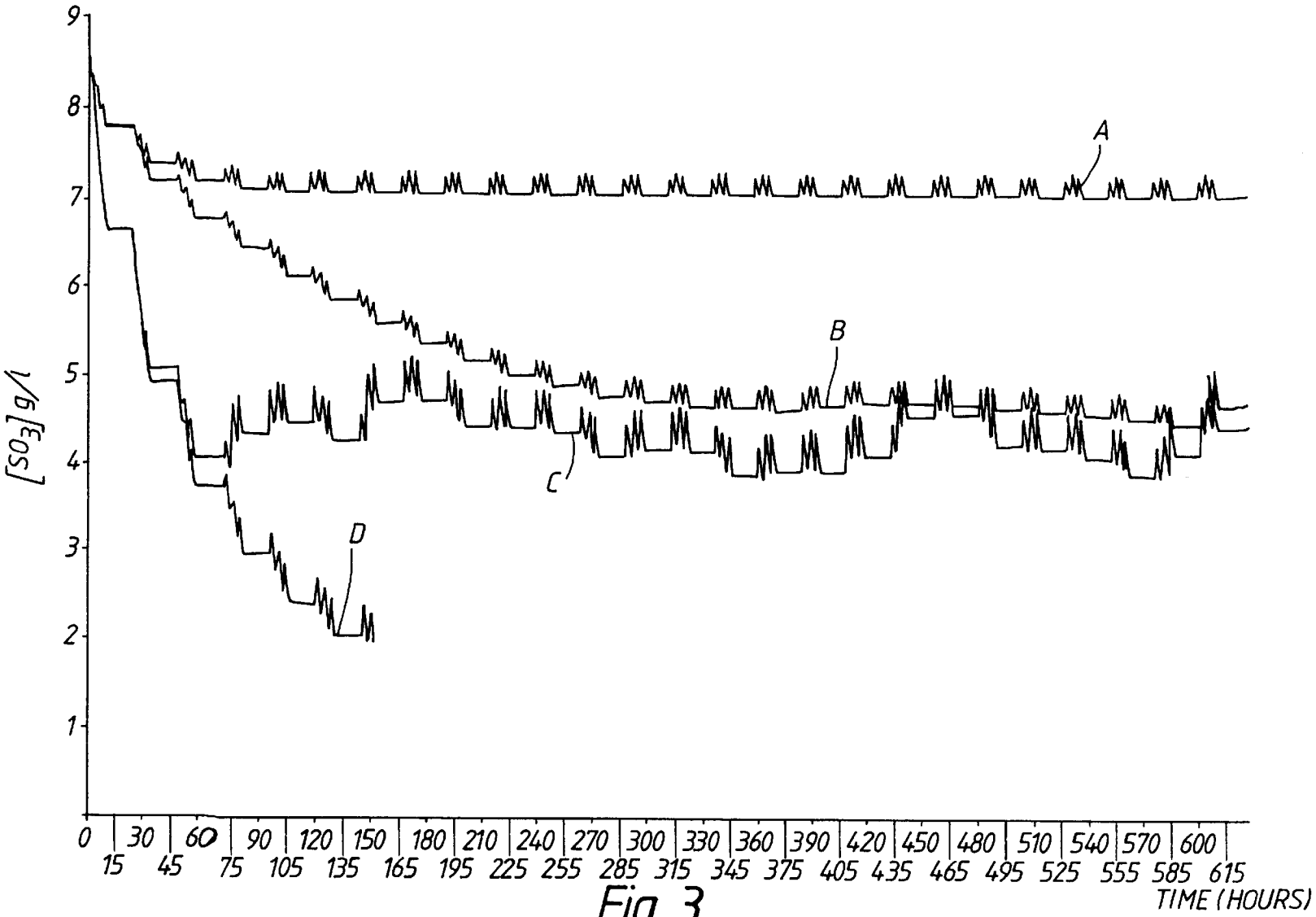
FIG. 3 is a plot of sulphite concentration against time for a regeneration regime according to the invention.

The result of using this regeneration regime for 25 days is shown in the attached FIG. 3 which is a plot of sulphite concentration against time. Sulphite concentration is an indication of the condition of the fixer, and in this Example a sulphite concentration of 2 g/l or less is considered unsatisfactory. In this plot, the results according to the invention are shown by lines "B" and "C".

In the case of line "B", where the image density was 50%, the initial regeneration rate was about 400 ml/$m^2$ falling to 120 ml/$m^2$. It will be seen that sulphite concentration falls from its initial, excess level of 8.5 g/l to stabilise at about 4.5 g/l, comfortably above the minimum acceptable level of 2.0 g/l.

In the case of line "C", where the image density was 85%, the initial regeneration rate was about 40 ml/$m^2$ (equivalent to a regeneration rate of 125 ml/$m^2$ at 50% image density). It will be seen that sulphite concentration falls from its initial level to a minimum of about 4.0 g/l, at which point the concentration becomes stabilised, again comfortably above the minimum acceptable level of 2.0 g/l. The small spikes shown on this line indicate each addition of fresh fixer. The regeneration rate increased to 60 ml/$m^2$ during this process.

By way of comparison, the Example was modified as set out below and the results of these modifications are indicated by lines "A" and "D" in FIG. 3.

Line "A" indicates the results obtained with a 50% image density where a constant regeneration at a rate of 400 ml/$m^2$ was used. It will be seen that over-regeneration has occurred, which is wasteful of materials.

However, line "D" indicates the results obtained with a 85% image density, where the regeneration rate is constant at 40 ml/$m^2$. The sulphite concentration did not stabilise but fell below the acceptable 2.0 g/l level, at which point this experiment was stopped.

| Reference Number List | |
|---|---|
| photographic material supply 101 | lower opening 18 |
| imaging apparatus 102 | path 20 |
| input line 103 | sheet material 22 |
| development cell 104 | arrow A |
| fixing cell 105 | rollers 28, 30 |
| washing cell 106 | treatment liquid 24 |
| drying compartment 107 | passage 26 |
| fresh developer supply 108 | distance H |
| fresh fixer supply 109 | surface 25 |
| electrolytic cell 110 | core 32 |
| area measuring device 111 | elastomeric covering 34 |
| electrical circuit 112 | nip 36 |
| control device 113 | stationary sealing member 38, 39 |
| drive device 114 | sealing support 40 |
| cells 12, 12', 12" | flanges 19, 21 |
| vessel 13 | bolts 23 |
| housing wall 14 | leakage tray 42 |
| upper part 15 | |
| upper opening 17 | |
| lower part 16 | |

I claim:

1. A method for processing exposed silver-based photographic material comprising passing said exposed material through a bath of developer liquid and subsequently through a bath of fixer liquid, recovering silver from used fixer liquid by electrolysis and periodically regenerating said used fixer liquid by the addition of fresh fixer thereto, characterised by measuring the fractional image exposure of exposed material to be processed in a coming period, measuring the amount of silver recovered by electrolysis in a preceding period, and calculating the quantity of fresh fixer to be added as a function of said measured fractional image exposure and as a function of said measured amount of recovered silver.

2. A method according to claim 1, wherein said bath of fixer liquid is present in a closed processing apparatus.

3. A method according to claim 1, wherein the fresh fixer is preferably added periodically, and the quantity of fresh fixer ($Q_n$) to be added per unit area of photographic material is calculated according to the formula:

$$Q_n = K_1 + (1-\alpha)\cdot C_n \tag{1}$$

wherein:

$K_1$ is a first constant, specific to a given processing apparatus (typically in $ml/m^2$);

$\alpha$ is the average fractional image density of the photographic material to be processed in the coming period (unit-less); and $$c_n = a * c_{n-1} + (1-a) * \frac{t = n-1 \int^{t=n} I\,dt * k_2}{t = n-1 \int^{t=n} (1-\alpha) M\,dt} \tag{3}$$

where

I=the average electrolysis current during the preceding period;

t=the time of the preceding period;

$k_2$=a second constant;

M=the area of exposed material processed during the coming time period; and a is less than 1, such as more than 0.5, especially from 0.85 to 0.95.

* * * * *

UNITED STATES PATENT AND TRADEMARK OFFICE

CERTIFICATE OF CORRECTION

PATENT NO. : 5,928,843

DATED : July 27, 1999

INVENTOR(S) : Werner Van de Wynckel

It is certified that error appears in the above-identified patent and that said Letters Patent is hereby corrected as shown below:

On the title page, item

[73] Assignee: "Agfa-Gevaerf," should read -- Agfa-Gevaert, --.

Signed and Sealed this

Twenty-first Day of November, 2000

*Attest:*

Q. TODD DICKINSON

*Attesting Officer*

*Director of Patents and Trademarks*